US010252301B2

(12) United States Patent
Haas et al.

(10) Patent No.: US 10,252,301 B2
(45) Date of Patent: Apr. 9, 2019

(54) CLEANING DEVICE AND METHOD FOR CLEANING CONTAINERS

(71) Applicant: KHS GmbH, Dortmund (DE)

(72) Inventors: Gernot Haas, Eisenberg (DE); Olaf Muszinski, Kronberg (DE); Felix Wagner, Wiesbaden (DE)

(73) Assignee: KHS GmbH, Dortmund (DE)

( * ) Notice: Subject to any disclaimer, the term of this patent is extended or adjusted under 35 U.S.C. 154(b) by 195 days.

(21) Appl. No.: 15/105,910

(22) PCT Filed: Nov. 27, 2014

(86) PCT No.: PCT/EP2014/075756
§ 371 (c)(1),
(2) Date: Jun. 17, 2016

(87) PCT Pub. No.: WO2015/090888
PCT Pub. Date: Jun. 25, 2015

(65) Prior Publication Data

US 2016/0318076 A1 Nov. 3, 2016

(30) Foreign Application Priority Data

Dec. 18, 2013 (DE) ..... 10 2013 114 383

(51) Int. Cl.

| | |
|---|---|
| ***B08B 9/08*** | (2006.01) |
| ***B08B 5/04*** | (2006.01) |
| ***B67D 1/07*** | (2006.01) |
| ***B67D 1/08*** | (2006.01) |

(52) U.S. Cl.
CPC ..... *B08B 9/0813* (2013.01); *B08B 5/04* (2013.01); *B08B 9/0804* (2013.01); *B67D 1/07* (2013.01); *B67D 1/0801* (2013.01); *B67D 2001/0822* (2013.01)

(58) Field of Classification Search
None
See application file for complete search history.

(56) References Cited

U.S. PATENT DOCUMENTS

| | | | | |
|---|---|---|---|---|
| 3,140,828 | A | 7/1964 | Gaianor | |
| 2012/0315165 | A1* | 12/2012 | Dreifert | F04C 29/047 417/410.1 |

FOREIGN PATENT DOCUMENTS

| | | | | |
|---|---|---|---|---|
| DE | 3602209 | A1 * | 7/1987 | B08B 9/0813 |
| DE | 19933376 | A1 * | 2/2001 | B08B 9/08 |
| EP | 0 237 188 | A1 | 9/1987 | |
| EP | 0237188 | A1 * | 9/1987 | B08B 9/0804 |
| EP | 1748573 | A1 * | 1/2007 | H04B 3/54 |

* cited by examiner

*Primary Examiner* — Eric W Golightly
(74) *Attorney, Agent, or Firm* — Occhiuti & Rohlicek LLP

(57) ABSTRACT

A cleaning device for cleaning a reusable cask includes a treatment head that is connectable to a keg fitting of a reusable cask. The treatment head delivers fluid into the interior and also removes fluid from the interior. The treatment head connects at least temporarily to a pump that sucks fluid from the cask's interior. A bypass line connects the pump to a valve mechanism that provides selected fluids.

25 Claims, 4 Drawing Sheets

CLEANING DEVICE AND METHOD FOR CLEANING CONTAINERS

RELATED APPLICATIONS

This is the national stage, under 35 USC 371, of PCT/EP2014/075756, filed on Nov. 27, 2014, which claims the benefit of the Dec. 18, 2013 priority date of German application DE102013114383.0, the contents of which are herein incorporated, by reference.

FIELD OF INVENTION

The invention relates to cleaning reusable casks.

BACKGROUND

Reusable casks, also known as kegs, are known in the beverage industry. Once a cask's liquid contents have been removed, it is usual to clean its interior so that it can be re filled with liquid contents. This removes any product residues in the cask's interior. A known cleaning method is a CIP method.

Cleaning requires a number of evacuating steps. These steps involve evacuating product residues and cleaning or rinsing fluids from a reusable cask's interior. It is usual for these evacuating steps to be assisted by compressed air. In particular, it is common to pressurize, or pre tension the cask's interior with compressed air to force out any fluid present in the cask's interior.

A disadvantage of the prior art is that compressed air is frequently only available at the cleaning device at a certain pre-determined operating pressure. This pressure is often such as to promote only an inadequate and time-consuming expulsion of the fluid present in the reusable cask. The energy efficiency of the compressed air-based pumping principle known from the prior art is also poor.

SUMMARY

An object of the invention is to reduce the minimize the time needed and energy consumed while evacuating a reusable cask's interior.

The invention relates to a device for cleaning reusable casks. Such a device includes a treatment head that is connectable to a cask's valve mechanism. The valve mechanism has a first opening that connects to a central pipe extending into the cask's interior. It also has a second opening that is directly connected to the cask's interior. The treatment head is configured for delivering fluids, in particular cleaning and rinsing media, into the cask's interior, and for then removing the fluids from the cask's interior. The treatment head is at least temporarily connected to a pump mechanism that sucks fluids out of the cask's interior. This pump mechanism promotes rapid evacuation of the reusable cask combined with improved energy efficiency.

In a preferred embodiment, the suction side of the pump mechanism connects to the second opening of the valve mechanism. As a result, fluids that have entered the interior of the reusable cask through the first opening of the valve mechanism can be evacuated from its interior by a pump-generated vacuum. The second opening is directly on the upper end face of the reusable cask. This means that when the reusable cask is held in the inverted position during the cleaning process, the opening is at the lowest point on the reusable cask. This permits a complete evacuation of the residues. Alternatively, it is also possible for the treatment to take place in a normal position in which the valve mechanism is on top.

In this case, the suction side of the pump mechanism connects to the valve mechanism's first opening so that the fluids can be sucked out through a central pipe. The cleaning fluids can be delivered to the interior of the reusable cask through the second opening. It is also possible for the suction side of the pump mechanism to be connected, at least temporarily, to the first and second opening of the valve mechanism at the same time or to the first opening and then to the second opening of the valve mechanism alternately. This can also evacuation of the reusable cask.

Some embodiments feature a way to control the pump mechanism's suction power. Examples include electronic controllers, or mechanical controllers. Among these are embodiments in which a controller regulates the volumetric flow of the fluids discharged from the reusable cask.

Some embodiments rely at least in part on flow meters or pressure measuring devices to control suction power. These determine measured variables, such as pressure, volumetric flow rate, and mass flow rate. The measured variables can then be used as input variables for controlling the suction power. Time-based control is also possible as an alternative or in addition to control based on measured values.

According to one embodiment, a controller for controlling the pump mechanism's suction power comprises a control valve between the treatment head and the pump mechanism. Alternatively, a suitable controller includes a frequency converter associated with the pump mechanism that can regulate the electric power of the pump mechanism.

A preferred embodiment comprises treatment heads connected to a common pump mechanism. This reduces plant complexity while effectively removing fluids from a plurality of reusable casks that are, for example, disposed at different treatment stations of the cleaning device.

Alternatively, a plurality of treatment-head groups may each be provided with a plurality of treatment heads, with each treatment-head group being assigned its own separate pump mechanism. In these embodiments, one pump mechanism connects to all of the treatment heads of a treatment-head group.

In some embodiments, the pump mechanism's delivery side connects to a valve array that comprises a plurality of valves arrayed in parallel for separating the individual fluids and/or cleaning and rinsing media. These valves can be operated as demand requires so that only one of these valves is open at any time. This open valve would be whichever valve connects to a collecting pipe or a collecting space for the particular fluid being conveyed through the pump mechanism at that time. During the switch from a first fluid used in a first treatment step to a second fluid used in a subsequent treatment step, it is possible to change over the valve states. This means closing an open valve and opening a closed valve. This tends to minimize mixing phases, in which different fluids, such as different cleaning and rinsing media, mix with each other.

Another embodiment includes a plurality of treatment heads, each of which connects to a separate dedicated pump mechanism. This reduces the time needed to evacuate the reusable casks. In this embodiment, each pump mechanism is assigned to a dedicated valve array comprising a plurality of valves arrayed in parallel for separating the individual fluids. This makes it possible for the valve array associated with a particular treatment station to separate the fluids evacuated from the reusable casks. Because this separation occurs at each treatment station of the cleaning device, this improves separation between individual fluids.

The first opening is preferably connected through the treatment head to a mechanism for supplying different fluids, in particular cleaning and rinsing media. Different cleaning fluids, for example acids, bases, disinfectants or also water, in particular cold water, hot water or water vapor that are used for cleaning, can be introduced into the interior of the reusable cask by this mechanism. The mechanism can be associated with a plurality of valves with which the different fluids can be delivered in a controlled manner depending on the treatment step.

The first opening is preferably connected through the treatment head, at least temporarily, to a mechanism for supplying a pressurized gaseous medium. The pressurized gaseous medium can be compressed air, in particular sterile compressed air, or an inert gas, such as CO2. The interior of the reusable cask can then be pre-tensioned with a positive pressure. This promotes evacuation of the fluid present in the reusable cask's interior.

It is preferable that the cleaning device be configured so that an evacuation of the reusable cask is effected by extracting the cleaning and rinsing media through the second opening while at the same time pressurizing the reusable cask with a pressurized gaseous medium at the first opening. The simultaneous ore tensioning of the interior of the reusable cask with the pressurized gaseous medium and the process of extracting by the pump mechanism can achieve an extremely effective evacuation of the reusable cask with high energy efficiency.

Alternatively however, the reusable cask may also be evacuated by sucking out the cleaning and rinsing media through the first opening while at the same time pressurizing the reusable cask with a pressurized gaseous mediums at the second opening. In this case the reusable cask is preferably in the normal position, i.e. the valve mechanism that comprises the first and second opening is arranged above the base section of the reusable cask. Again alternatively, the reusable cask may be evacuated by sucking out the cleaning and rinsing media and pressurizing the reusable cask with a pressurized gaseous medium through the same opening, i.e. the first or second opening, but in chronologically sequential treatment steps.

In some embodiments, the pump mechanism connects by a bypass line to a valve mechanism delivering the fluids. The pipes can be selectively emptied and/or cleaned by the delivery of a liquid and/or gaseous fluid through this bypass line, which circumvents the valve mechanism by creating a bypass.

In another aspect, the invention includes a method for cleaning reusable casks by way of a device comprising at least one treatment head that connects to a valve mechanism of a reusable cask. Such a valve mechanism comprises a first opening that connects to a central pipe extending in the interior of the reusable cask, and a second opening that is directly connected to the interior of the reusable cask, with fluids, in particular cleaning and rinsing media, being delivered through the treatment head into the interior of the reusable cask that is to be cleaned and then removed from the reusable cask after the cleaning and rinsing operation. The treatment head connects, at least temporarily, to a pump mechanism by way of which the fluids are sucked out of the interior of the reusable cask.

The suction power of the pump mechanism is preferably controlled by a control valve provided between the treatment head and the pump mechanism. Alternatively the pumping power of the pump mechanism can be controlled by a frequency regulator. For example, the frequency regulator controls the pump mechanism based on measured values (e.g. fluid pressure, fluid flow rate and/or time.

Also preferably, the fluids, in particular cleaning and rinsing media, are separated by a plurality of valves arrayed in parallel and connected on the pressure side to the pump mechanism.

It is preferable if the cleaning device is provided with a plurality of treatment heads, with two or more treatment heads being connected to a common pump mechanism or with each treatment head being associated with a separate pump mechanism. This latter may be necessary to ensure optimum plant performance.

In another preferred embodiment the interior of the reusable cask is, at least temporarily, simultaneously supplied with a pressurized, gaseous medium through the first opening and through the second opening with a vacuum provided by the pump mechanism for the evacuation of the interior of the reusable cask.

As used herein, the expressions "essentially", "in essence" and "around" mean variations from the respective exact value by ±10%, preferably by ±5%, and/or variations in the form of changes insignificant for the function.

As used herein, a "medium" is a cleaning or rinsing medium, and "media" refers to the plural of "medium." Examples of media include bases, water, including hot water, cold water or water vapor, disinfectants, as well as gaseous media such as $CO_2$, compressed air, sterile compressed air, or atmospheric air.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures.

DETAILED DESCRIPTION

Figure 1:
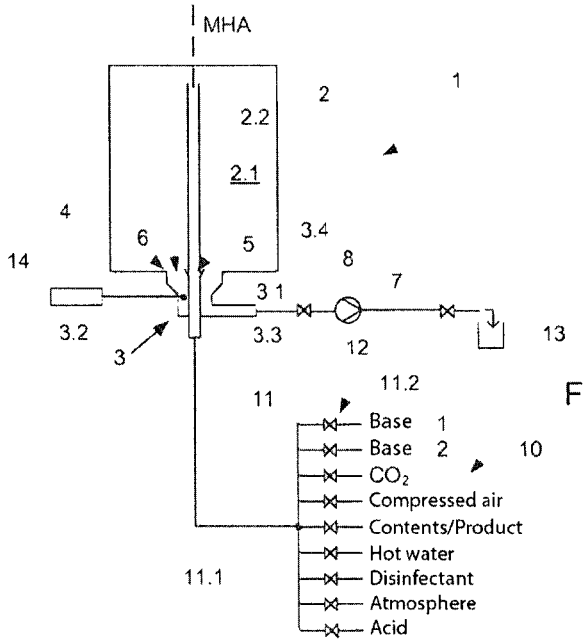
FIG. 1 shows a simplified view of an inventive cleaning device.

FIG. 1 shows a first embodiment of a cleaning device 1 that is used to clean a reusable cask 2, also known as a keg. The reusable cask 2 has a valve mechanism, or keg fitting 4, on an end face thereof. The end face is typically on the top of the cask 2.

The keg fitting 4 forms first and second openings 5, 6. The keg fitting 4 is a self-closing valve that can be opened for cleaning and/or filling the reusable cask 2. The keg fitting 4 is positioned on a treatment head 3 provided at the treatment station such that the treatment head 3 releases the keg fitting 4 and opens the first and second openings 5, 6.

The first opening 5, which is co-axial with a median vertical axis MHA of the reusable cask 2, connects to a free end of a tubular central pipe 2.2 that is arranged in the interior of the reusable cask 2 co-axially with the median vertical axis MHA and that is configured to be open at an end thereof that lies opposite the base of the reusable cask 2.

The second opening 6 is an annular opening that surrounds the first opening 5 or the central pipe 2.2. This second opening 6 connects directly, with no interposed sections of pipe or other equipment, to an interior 2.1 of the reusable cask 2.

As shown in FIG. 1, the reusable cask 2 that is to be cleaned in an inverted position, i.e. with the keg fitting 4 facing downward, is placed on a treatment station of the cleaning device 1 where it engages a treatment bead 3.

The treatment head 3 comprises first and second coupling sections 3.1, 3.2. The first coupling section 3.1 creates a fluid-tight connection with the first opening 5. The second coupling section 3.2 creates a fluid-tight connection with the second opening 6.

Within the treatment head 3, the first and second coupling sections 3.1, 3.2 form separate first and second fluid channels 3.3, 3.4. The first fluid channel 3.3 includes a section that runs co-axial with the median vertical axis and hence co-axial with the central pipe 2.2. The second fluid channel 3.4 includes a section that surrounds the outside of the first fluid channel 3.3. Because of the separate first and second fluid channels 3.3, 3.4, it is possible to introduce a medium into the cask's interior 2.1 through the first opening 5 and to simultaneously remove it through the second opening 6.

A supply mechanism 10 supplies media to the first fluid channel 3.3 is a first 11. The first line 11 thus provides media to be introduced into the cask's interior 2.1 during cleaning thereof. A branch 11.1 connected to the first line 11 permits a choice between different media, each of which has a corresponding valve mechanism 11.2. Through appropriately synchronized operation, the valve mechanisms 11.2 provide a chronologically controlled and quantity-controlled delivery of each individual medium.

After cleaning and rinsing, the first line 11 introduces liquid product into the cleaned reusable cask 2 through the first line 11. The cleaning device 1 is thus able to both clean the cask 2 and refill it.

Meanwhile, a second line 12 connects the second fluid channel 3.4 to a pump 7 having a suction side and a pressure side.

The pump's suction side connects to either the second coupling section 3.2 or to the second fluid channel 3.4 that it forms. This enables the pump 7 to suck out any fluid introduced into the task's interior 2.1. This would include any media used to clean the interior 2.1 and any product residue still left in the interior 2.1.

The pump's pressure side connects to a discharge 13 through which fluids extracted from the interior 2.1 through the fluid channel 3.4 and the second line 12 can flow away.

The pump 7 can be any pump suitable for moving fluids. Examples include a reciprocating pump, an eccentric pump, a slide pump, a vacuum pump, a diaphragm pump, and in particular, an electrically-operated diaphragm pump.

Along the second fluid channel 3.4 is a measuring device 14 for providing a measurement signal that depends on the level of fluid inside the second fluid channel 3.4. Examples of a suitable measuring device 14 include a level sensor, a fluid sensor, and a pressure sensor. Combinations of these measuring devices are also possible. From the measurement signal, it is possible to actuate the pump 7 as a function of the fluid level in the second fluid channel 3.4.

Some embodiments include a controller for controlling the pump 7, and in particular, the pump's pumping power. Such a controller can be formed by a first control valve 8 positioned in the second line 12 between the treatment head 3 and the pump 7. The first control valve 8 regulates the volumetric flow through the second line 12. This, in turn, provides a way to regulate the volumetric flow of the fluid that the pump 7 sucks out of the cask's interior 2.1. Alternatively, a frequency inverter regulates the frequency of the pump 7.

The cleaning device 1 executes an emptying step in which the second fluid channel 3.4 drains any residual product content that may be left in the reusable cask 2. It then passes one or more cleaning agents, such as hot or cold water, bases, and/or acids through the cask's interior 2.1. In some practices, the cleaning device 1 executes intermediate rinsing between the individual cleaning steps. These include, if required, disinfecting the cask's interior 2.1 with a disinfectant. Finally, the cleaning device 1 executes a flushing step in which it flushes the cask's interior 2.1 with water to remove any traces of cleaning agents or disinfectants left in interior 2.1. In different practices, one or more of the foregoing steps may be omitted.

To further expedite the elimination of fluids through the second fluid channel 3.4, the supply mechanism 10 provides a pressurized gas. Suitable pressurized gases include compressed air, and in particular, sterile compressed air. This pressurized gas can be introduced into cask's interior 2.1 through the first line 11, the first fluid channel 3.3 and the central pipe 2.2 that connects to the first fluid channel 3.3. Introduction of this pressurized gas raises the pressure inside the reusable cask 2 above atmospheric pressure.

In some practices, the supply mechanism 10 delivers the pressurized gas while the pump 7 operates. This promotes much faster evacuation of fluids present in the cask's interior 2.1. In other practices, the cleaning device 1 pressurizes the cask's interior 2.1 in sequential time steps through the first and second fluid channels 3.3, 3.4, after which it extracts media through the same first and second fluid channels 3.3, 3.4.

Figure 2:
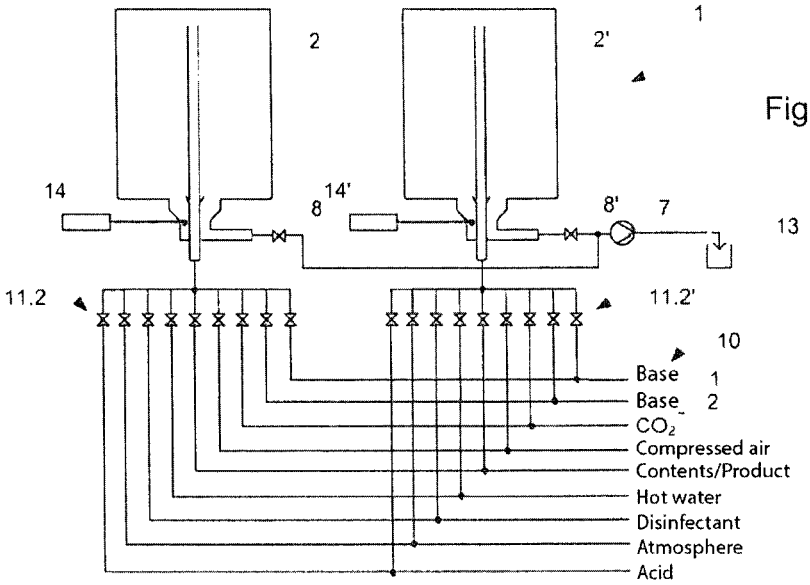
FIG. 2 shows a simplified view of a vertical section through a second embodiment of an inventive cleaning device having a plurality of treatment heads.

FIG. 2 shows a second embodiment of the cleaning device 1. The following sections only describe the differences between this second embodiment and the first embodiment shown in FIG. 1. Otherwise the above descriptions also apply to this second embodiment.

The cleaning device 1 according to FIG. 2 comprises a plurality of treatment stations, with each treatment station comprising a treatment head 3, 3'. The treatment stations can be configured on a rotor of a rotating machine. First fluid channels 3.3 of treatment heads 3, 3' are each connected to a supply mechanism 10 that makes the media available. Preferably, different valve mechanisms 11.2, 11.2' are assigned to the individual treatment stations so that the latter can be supplied with media and/or other fluids independently of one another.

Second fluid channels 3.4 connect to a single pump 7 that extracts fluids from a plurality of reusable casks 2, 2'. The casks 2 are arranged at different treatment heads 3, 3' or at different treatment stations of cleaning device 1. Each treatment head 3, 3' can be assigned a first control valve 8, 8' that controls suction power acting at that treatment station.

Figure 3:
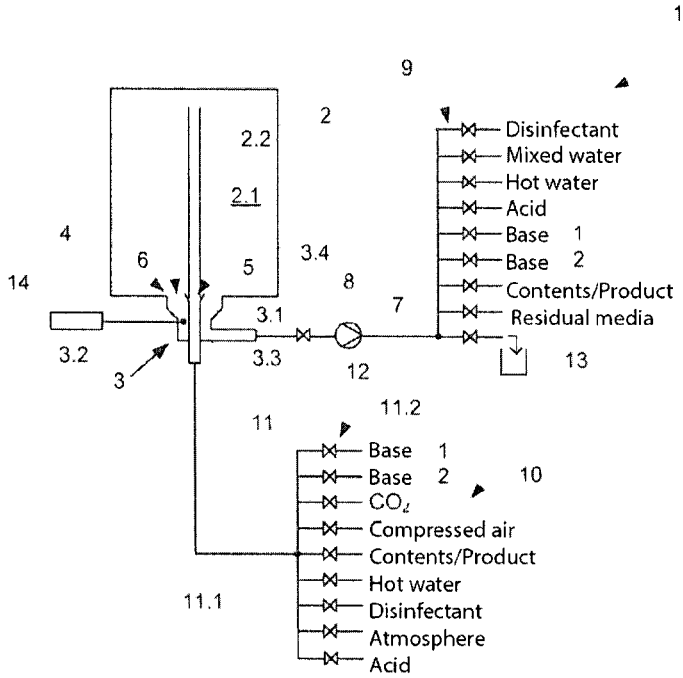
FIG. 3 shows a simplified view of an inventive cleaning device having a mechanism for separating the media.

FIG. 3 shows a third embodiment of the cleaning device 1 in which, as a variation on the embodiment shown in FIG.

1, the pressure side of pump 7 connects to a valve array 9 that separates the fluids removed from the cask's interior 2.1.

The valve array 9 comprises a plurality of controllable valves. A first valve controls removal of a first base, a second valve controls removal of a second base, a third valve controls removal of residual product contents and a fourth valve controls removal of media residues. The valves of the valve array 9 are operated as a function of the position of the respective valves of the valve mechanism 11.2 in such a way that only one of the valves is open at any one time. This valve is the one that is associated with the medium whose extraction from reusable cask 2 is currently ongoing. Using the valve array 9, the extracted fluids can be removed, collected, if necessary reused, e.g. through a guide in a fluid circuit, and if necessary recycled, separately from one another.

Figure 4:
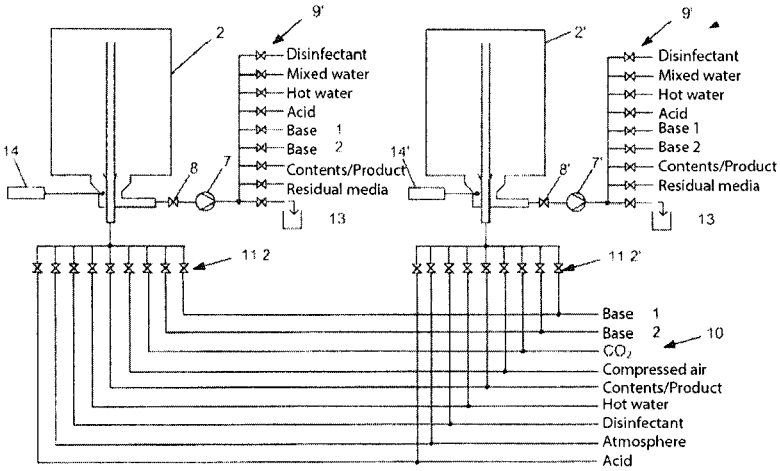
FIG. 4 shows a simplified view of an inventive cleaning device having a plurality of treatment heads and having mechanisms for separating the media.

As a variation on the embodiment shown in FIG. 2, FIG. 4 shows a cleaning device 1 having a plurality of treatment stations that are each provided with a mechanism for separating the fluids extracted from reusable casks 2, 2' in order to achieve an effective separation of the extracted fluids. The entire cleaning operation of a reusable cask 2 typically comprises a plurality of treatment steps, and the treatment steps in progress at the individual treatment stations at any given time are different, with the result that different fluids are extracted from respective reusable casks 2, 2'. In order to prevent the fluids that are being pumped out of the individual treatment stations from being mixed together when evacuation is by a single pump 7, thus rendering effective separation impossible, each treatment head 3, 3' is provided with a dedicated pump 7, 7' as well as a mechanism for separating the fluids, i.e. a separate valve array 9, 9'. The valves of the individual valve arrays 9, 9' can thus be actuated as a function of the fluid being pumped by the pump 7, 7' at the respective treatment station. The separated fluids can then be delivered to collecting or processing mechanisms that are provided for all treatment stations in common.

Figure 5:
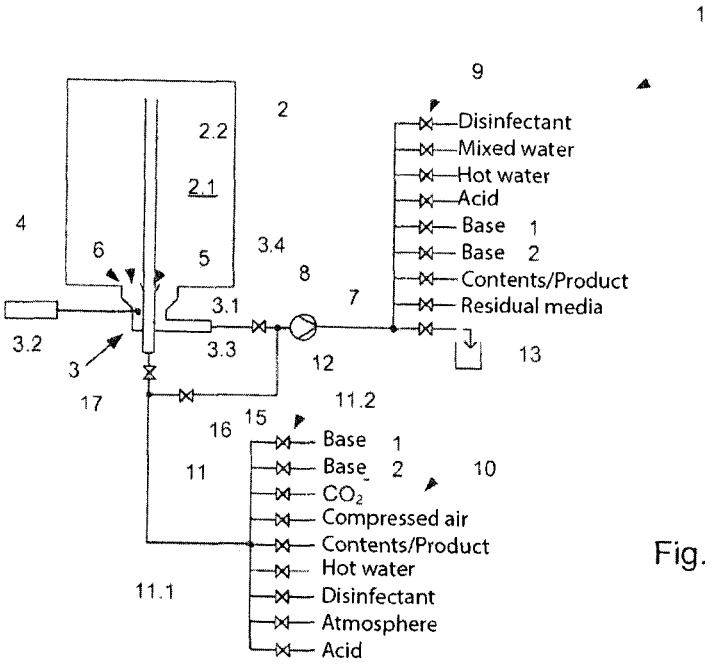
FIG. 5 shows a further embodiment of the cleaning device.

FIG. 5 shows a further embodiment of the cleaning device 1 that is similar to the embodiment shown in FIG. 3. The essential difference, between the embodiments in FIG. 3 and FIG. 5 is that the embodiment of FIG. 5 features a bypass line 15 to connect the first line 11 to the suction side of the pump 7. A bypassing of the treatment head 3 can be effected under the control of second and third control valves 16, 17 and the first control valve 8, i.e. the bypass line 15 can establish a direct connection between the first line 11 and the pump 7. This makes possible a direct controlled and/or cleaning of the first and second lines 11, 12 and/or of the pump 7.

The invention has been described hereinbefore by reference to embodiments. It goes without saying that numerous variations as well as modifications are possible without departing from the inventive concept underlying the invention.

The invention claimed is:

1. An apparatus comprising: a cleaning device for cleaning a reusable cask, said cleaning device comprising a first treatment head, a first pump, a bypass line, and a valve mechanism for delivering fluids, wherein said first treatment head is connectable to a keg fitting of a reusable cask, said keg fitting comprising a first opening that connects to a central pipe that extends into an interior of said cask and a second opening connected directly to said interior, said first treatment head being configured to deliver fluid into said interior and to remove fluid from said interior, wherein said first treatment head comprises a first coupling section that is configured to connect to said first opening and a second coupling section that is configured to connect to said second opening, wherein said first treatment head is configured to connect at least temporarily to said first pump, wherein said first pump comprises a suction side and a pressure side that differs from said suction side, wherein said first pump is configured to suck fluid from said interior through said suction side and to discharge fluid through said pressure side, and wherein said bypass line connects said first pump to said valve mechanism.

2. The apparatus of claim 1, wherein said suction side of said first pump connects to said second coupling section, which connects to said second opening.

3. The apparatus of claim 1, wherein said suction side of said first pump connects to said first coupling section, which connects to said first opening.

4. The apparatus of claim 1, further comprising a controller for controlling suction power of said first pump.

5. The apparatus of claim 4, wherein said controller comprises a control valve between said first treatment head and said first pump.

6. The apparatus of claim 4, wherein said controller comprises a frequency converter associated with said first pump.

7. The apparatus of claim 1, further comprising additional treatment heads, each of which is connected to said first pump.

8. The apparatus of claim 1, further comprising a valve array, wherein a pressure side of said pump connects to said valve array, wherein said valve array comprises an array of valves connected in parallel for separating media.

9. The apparatus of claim 1, further comprising first and second valve arrays, wherein said first pump is assigned to said first valve array, wherein a second pump is assigned to said second valve array, wherein each of said first and second valve arrays comprises valves arranged in parallel for separating a individual fluids and/or cleaning and rinsing media.

10. The apparatus of claim 1, further comprising a supply mechanism configured to supply a variety of media, wherein said treatment head provides a connection between said supply mechanism and said first coupling section, which connects to said first opening.

11. The apparatus of claim 1, further comprising a supply mechanism that supplies pressurized gas, wherein said first coupling section, which is connected to said first opening, connects at least temporarily to said supply mechanism via said treatment head.

12. A method comprising: cleaning an interior of a first reusable cask, wherein cleaning said first reusable cask comprises connecting a first treatment head of a cleaning device to a keg fitting of said first reusable cask, said keg fitting comprising a first opening that leads into a central pipe extending into said interior and a second opening that leads directly to said interior, wherein connecting comprises connecting a first coupling section of said first treatment head to said first opening and connecting a second coupling section of said treatment head to said second opening, delivering medium through said first treatment head into said interior, and removing said medium from said first reusable cask through said first treatment head, wherein removing said medium comprises temporarily connecting a suction side of a first pump to suck said medium from said interior, and temporarily connecting a pressure side of said first pump, via a bypass line, to a valve mechanism that delivers fluids.

13. The method of claim 12, further comprising using a frequency inverter to control suction power of said first pump.

14. The method of claim 12, further comprising connecting a pressure side of said first pump to a plurality of valves arrayed in parallel and, using said valves, separating media collected from said interior.

15. The method of claim 12, further comprising connecting a second treatment head to a second reusable cask, said second treatment head being connected to said first pump, and, using said second treatment head, cleaning an interior of said second reusable cask.

16. The method of claim 12, further comprising connecting a second treatment head to a second reusable cask, said second treatment head being connected to a second pump, and, using said second treatment head, cleaning an interior of said second reusable cask.

17. The apparatus of claim 1, wherein said cleaning device is configured to evacuate said cask through one opening via one coupling section and to pass pressurized gas through another opening via another coupling section and wherein said one opening and said another opening are selected from among said first and second openings and wherein said one coupling section and said another coupling section are selected from among said first and second coupling sections.

18. The apparatus of claim 17, wherein said cleaning device is configured to evacuate said cask and to pass said pressurized gas concurrently.

19. The apparatus of claim 17, wherein said cleaning device is configured to evacuate said cask and to pass said pressurized gas at different times.

20. The method of claim 12, further comprising passing a pressurized gas through one of said first and second openings and into said interior and connecting another of said first and second openings to said first pump to evacuate said interior, wherein said one opening and said another opening are selected from among said first and second openings.

21. The apparatus of claim 1, wherein said suction side of said first pump connects to said first and second openings via said first and second coupling sections.

22. The apparatus of claim 1, wherein said suction side connects to said first opening and second opening simultaneously via said first and second coupling sections.

23. The apparatus of claim 1, wherein said suction side of said first pump connects to said first and second openings via said first and second coupling sections at different times.

24. The apparatus of claim 7, further comprising a second pump and treatment heads in addition to said additional treatment heads, said treatment heads in addition to said additional treatment heads being connected to said second pump.

25. The apparatus of claim 7, wherein said first pump is a pump that differs from a pump to which treatment heads in addition to said additional treatment heads connect.

* * * * *